US005681129A

United States Patent [19]

Nicodemo et al.

[11] Patent Number: 5,681,129

[45] Date of Patent: *Oct. 28, 1997

[54] METHOD FOR MARKING GRASS FIELDS AND APPARATUS FOR APPLYING SUCH METHOD

[75] Inventors: Carlo Nicodemo, Cavarzere, Italy; Ewald Möhring, Salgen, Germany

[73] Assignee: Athar International Services SA, Tortola, Virgin Islands (Br.)

[ * ] Notice: The term of this patent shall not extend beyond the expiration date of Pat. No. 5,540,516.

[21] Appl. No.: 655,218

[22] Filed: Jun. 5, 1996

Related U.S. Application Data

[63] Continuation of Ser. No. 280,661, Jul. 27, 1994, Pat. No. 5,540,516.

[30] Foreign Application Priority Data

Jul. 28, 1993 [CH] Switzerland ..... 2273/93

[51] Int. Cl.[6] ..... E01F 9/06

[52] U.S. Cl. ..... 404/72; 404/75; 404/85; 404/93

[58] Field of Search ..... 47/1.01, 1.5; 15/79.1, 15/79.2; 404/12, 42, 93, 94, 122, 131, 123, 125, 126, 17, 72, 75, 85; 56/10.2 A, 10.2 E, 16.4 B, DIG. 3, DIG. 12, DIG. 19; 472/92

[56] References Cited

U.S. PATENT DOCUMENTS

| | | | |
|---|---|---|---|
| 1,102,443 | 7/1914 | Schamell | 404/123 |
| 2,721,405 | 10/1955 | Gardner | 404/126 X |
| 3,364,665 | 1/1968 | Vigen | 56/16.4 B |
| 3,731,468 | 5/1973 | Blumhardt | 56/16.4 B |
| 4,192,626 | 3/1980 | Wyckoff et al. | 404/123 |
| 5,076,367 | 12/1991 | Reincke | 56/DIG. 12 X |
| 5,337,833 | 8/1994 | Rizzo | 404/126 X |
| 5,395,182 | 3/1995 | Rossburger | 404/122 |
| 5,486,067 | 1/1996 | Huynh et al. | 404/94 X |
| 5,540,516 | 7/1996 | Nicodemo et al. | 404/12 |

FOREIGN PATENT DOCUMENTS

| | | |
|---|---|---|
| 2 085 403 | 12/1971 | France . |
| 2 567 359 | 1/1986 | France . |
| 9 319 582 | 10/1993 | WIPO . |

*Primary Examiner*—James Lisehora
*Attorney, Agent, or Firm*—Bacon & Thomas

[57] ABSTRACT

An advertising display method involves marking grass sports fields by bending the grass blades in definite zones and bending or leaving them straight in other zones in order to form an image or a word. The difference in the direction given to the grass blades is quite visible to the spectator. The grass blades are directed by means of an apparatus mounted on rollers which runs on the grass surface. The apparatus also has brushes and/or additional rollers which rotate to straighten the grass blades on definite sectors. The sectors form an image or the letters of a words. The engines which drive the apparatus and the brushes and/or rollers are electrical and are controlled by a computer. The image or word to represent on the grass, as well as the position of the apparatus on the surface to work, are entered in the memory of a computer.

10 Claims, 13 Drawing Sheets

FIG. 25
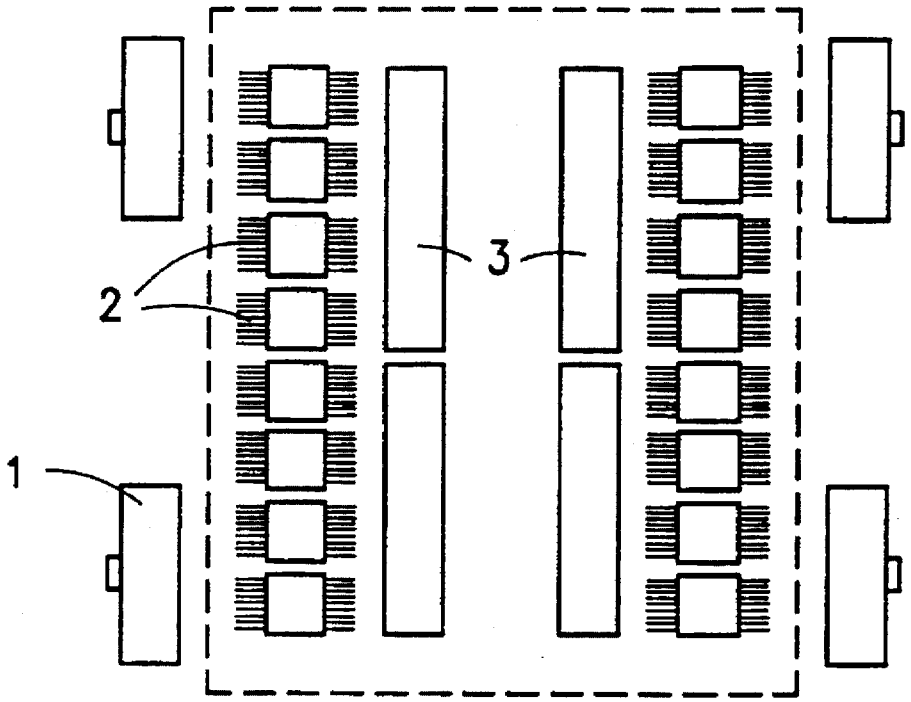
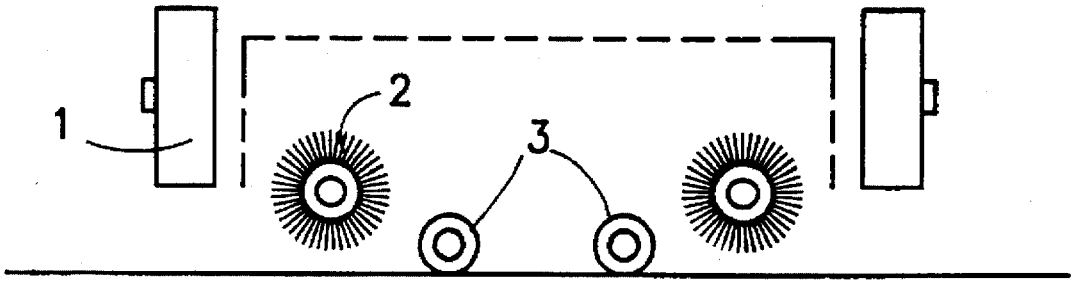
FIG. 26

METHOD FOR MARKING GRASS FIELDS AND APPARATUS FOR APPLYING SUCH METHOD

This application is a Continuation of application Ser. No. 08/280,661, filed Jul. 27, 1994, now U.S. Pat. No. 5,540, 516.

BACKGROUND OF THE INVENTION

1. Field of the Invention

The present invention relates to the field of mass communication techniques, and more particularly to advertising display technologies and to the exploitation of surfaces, such as sports fields, which have not previously been used for advertising displays.

2. Description of the Prior Art

During events which take place on grass fields, in particular sports events, many advertising panels usually border the field. The grass itself, however, although it is the place that the public sees most frequently, and is the largest surface that the spectators have before their eyes, does not carry any advertisements. The only marks which are printed on the grass are those related to the sport played on the field.

SUMMARY OF THE INVENTION

It is accordingly an objective of the invention to utilize the previously unused surface of a sports field for advertising display purposes by making possible the marking of messages, especially advertising messages, on the grass surface itself, without creating confusion with the sport markings.

It is another objective of the invention to provide a method for marking the grass with signs, such as letters forming words, names or numbers, or images, and to provide an apparatus capable of making such markings.

The invention has both method and apparatus embodiments.

In a first method embodiment of the invention, a preferred method of marking grass fields, especially sports fields, involves directing a part of the blades of a grass surface in one direction, and orienting or leaving oriented in at least one other direction at least another part of the blades of the grass surface so that at least one of the parts constitutes an image or sign.

In a second method embodiment of the invention, the method of the first embodiment is implemented by orienting the blades of at least a part of the grass surface by means of one or several brushes.

In a third method embodiment of the invention, the method of the second embodiment is implemented by using rotating brushes.

In a fourth method embodiment of the invention, the method of the first embodiment is implemented by orienting the blades of at least a part of the grass surface by means of one or several rollers.

In a fifth embodiment of the invention, the method of the first embodiment is implemented by orienting the blades of grass surfaces by means of one or several brushes and by means of one or several rollers.

In a sixth embodiment of the invention, the method of the three last above described embodiments involves dividing the model of the image or sign to be marked on the grass surface into several points, dividing the grass surface into several sectors, and commanding the action, and especially the lowering, the raising and/or the rotation of the brushes and/or the rollers in connection with the position of the brushes and/or rollers on definite sectors which correspond to definite points of the model of the sign or image to be marked on the grass surface.

In a seventh embodiment of the invention, the method of the last above described embodiment involves commanding the action, and especially the lowering, the raising and/or the rotation of the brushes and/or rollers, using a computer in which are inserted the model or models of the signs or images to mark on the grass surface, the model or models being divided in several points, the position of the brushes and/or rollers with regard to the position of the sectors of the grass surface and instructions which command the action with regard to the position of the brushes and/or rollers.

In a further version of the above described seventh embodiment of the invention, the preferred method involves using an apparatus on which are fixed the brushes or rollers, registering the position of the apparatus on the grass surface through sensors which detect magnetizable bodies that are deposited or buried at definite places on or under said grass surface.

In a further version of the above described seventh embodiment of the invention, the preferred method includes the steps of using an apparatus on which brushes or rollers are fixed and registering the position of the apparatus on the grass surface by means of a device which is able to emit and receive electromagnetic or sonic waves.

In a particular embodiment of that latter version, the device is able to receive signals from geostationary satellites.

The preferred apparatus for marking grass fields, in a first embodiment, includes wheels for moving the apparatus, brushes and/or rollers, and means for lowering down to the grass and raising from the grass, so that they do not touch grass any more, at least some of said brushes and/or rollers.

In a second apparatus embodiment, the preferred apparatus includes brushes which rotate and means for making the brushes rotate in two directions.

In a third embodiment of the preferred apparatus, which is a variant of the second embodiment, the apparatus includes means for lowering down to the grass and for raising from the grass, so that they do not touch the grass any more, at least some of the rotating brushes.

In a fourth embodiment of the preferred apparatus, the brushes and/or rollers according to one of the above apparatus embodiments are assembled in groups.

In a fifth embodiment of the preferred apparatus, at least a part of the rollers are mounted on one or more rotating barrels so that they can freely rotate.

In a sixth embodiment of the preferred apparatus the brushes and/or the rollers and/or the groups of brushes and/or rollers are staggeredly fixed to the apparatus.

In a seventh apparatus embodiment, the preferred apparatus according to one of the above described embodiments includes means for raising the wheels, and rollers which are able to support and to move the apparatus when the wheels have been raised up.

In an eighth apparatus embodiment, the preferred apparatus according to the seventh above described embodiment includes at least one engine which sets in motion the rollers which support the apparatus and a steering device for directing the apparatus when the wheels have been raised up.

In a ninth apparatus embodiment, the preferred apparatus according to the seventh or the eighth embodiments involves an arrangement for setting each roller or group of rollers and each brush or group of brushes in motion by a separate engine.

In a tenth apparatus embodiment, the preferred apparatus according to one of the above described embodiments comprises an odometer actuated by the rollers which support the apparatus or by a wheel which rolls on the grass surface and which registers the position of said apparatus on said grass surface.

In an eleventh apparatus embodiment, the preferred apparatus according to one of the four last above described embodiments is characterized in that the rotation axes of the wheels are perpendicular to the rotation axes of the rollers and/or brushes.

According to a variant of all of the above described apparatus embodiments, the preferred apparatus includes a computer in which the model or models of the image or images or of the sign or signs to be marked on the grass surface, as well as the position of the apparatus on the grass surface, are entered in the computer, the apparatus further including means by which the computer can actuate the brushes and/or the rollers according to the entries so that at least a part of the blades of the grass surface are oriented in a direction which is different from the direction of the other blades, so that at least a part of the grass surface constitutes an image or a sign which corresponds to the image or to the sign entered in the computer.

BRIEF DESCRIPTION OF THE DRAWINGS

FIG. 25 is a schematic plan view of a variant of the preferred apparatus shown in FIG. 19, in which the rotating barrels which bear rollers have been replaced by rotating brushes.

FIG. 26 is a schematic lateral view of the preferred apparatus shown in FIG. 25.

DETAILED DESCRIPTION OF THE PREFERRED EMBODIMENTS

Figure 1:
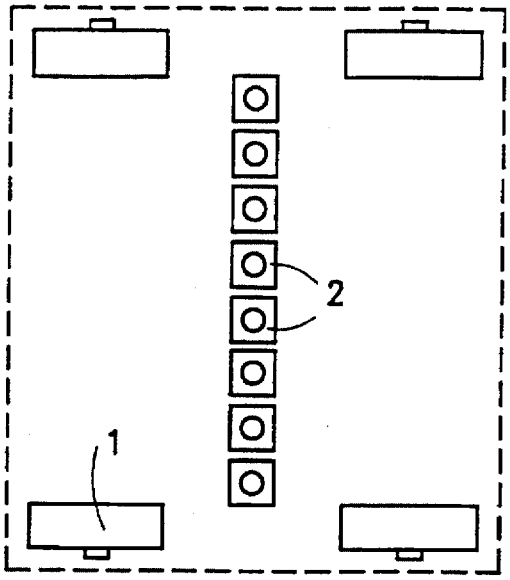
FIG. 1 is a schematic plan view of an apparatus according to a preferred embodiment of the invention.
Figure 2:
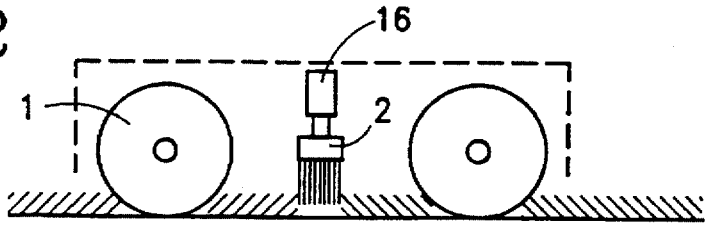
FIG. 2 is a schematic lateral view of the apparatus shown in FIG. 1.

In the embodiment schematically shown in FIGS. 1 and 2, the apparatus according to the invention is equipped with four wheels 1 and with a range of brushes 2, the bristles of which are vertically directed towards the grass. The wheels are used to move the apparatus to the grass surface to the work area to be marked, and to move it on the surface. The wheels are moved by one or several engines, which are preferably electrical, and which are not shown here, and are equipped with a steering device. Each brush can be lowered down to the grass and raised above the grass by raising and lower means 16. When the apparatus passes onto the grass surface to work, the brushes are lowered down when necessary. Each brush preferably has a width which corresponds to that of a definite sector of the surface to be worked.

Figure 32:
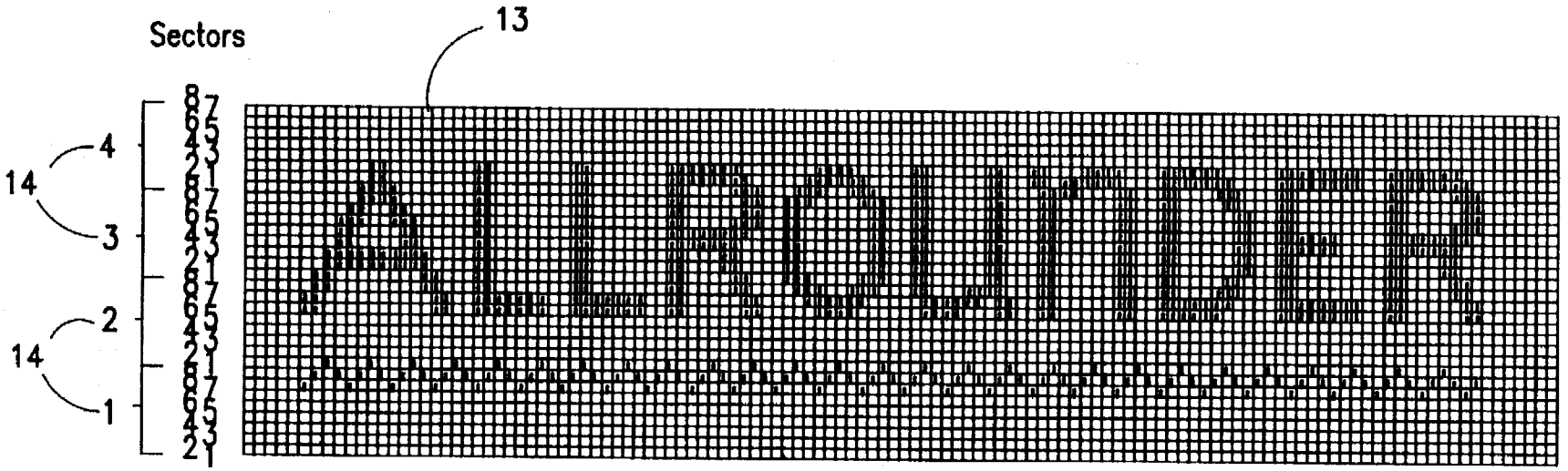
FIG. 32 shows a grass surface divided into several sectors with a mark imprinted with dots in chosen sectors, the whole of the dots forming the mark.

In a preferred method embodiment utilizing this simple apparatus, the grass surface to be marked is handled like a network of small sectors 13, which are preferably quadrangular, as shown in FIG. 32. If the width of the surface be marked is larger than the length of the row of brushes, it is useful to work the surface in several parallel strips 14, the width of which corresponds to the length of the range of brushes of the apparatus. The grass surface shown in FIG. 32 is so divided into four strips, the width of which corresponds to eight sectors, this latter number corresponding itself to the number of brushes with which the apparatus is equipped.

In operation, the apparatus rolls along the first strip and, when a brush passes over a sector to be marked, it is brought down to the grass and directs the grass blades as it goes by, up to the moment when it is raised up above the grass. FIG. 32 shows that, on the fourth strip, the third brush of the range is brought down on the twelfth and the thirteenth sectors from the left, and is raised afterwards, so marking the grass of the two sectors by directing their grass blades. A part of the letter A is thus imprinted in the grass.

The rest of the grass surface can of course remain as it was before, without any treatment. However, it is much preferable to have the apparatus pass a first time with all the brushes down, in one way, in order to direct all the grass blades on the whole strip. Afterwards, the apparatus runs on the same strip in the other direction, and the brushes are brought down only on the sectors which compose the sign or the image to be depicted. In that way, the blades are directed, approximately, in only two directions, which gives a sharper image. Once the first strip has been worked, the apparatus is put again on the starting line, at the beginning of the second strip, which is parallel and adjacent to the first strip, and the process is started again, until the whole grass surface is worked.

Figure 3:
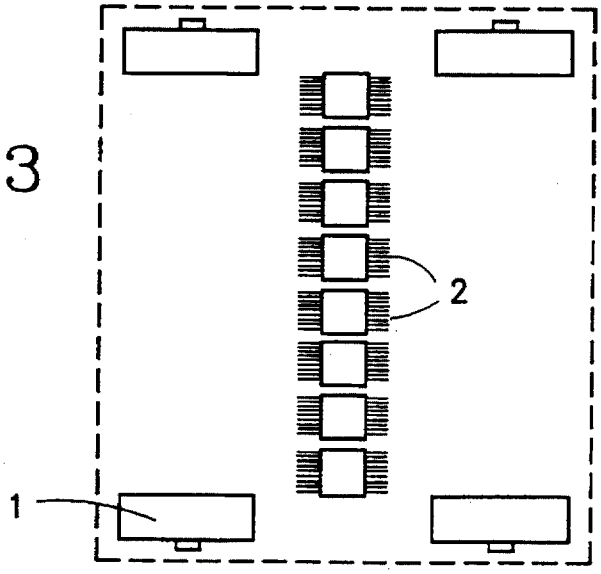
FIG. 3 is a schematic plan view of an apparatus according to a further embodiment of the invention.
Figure 4:
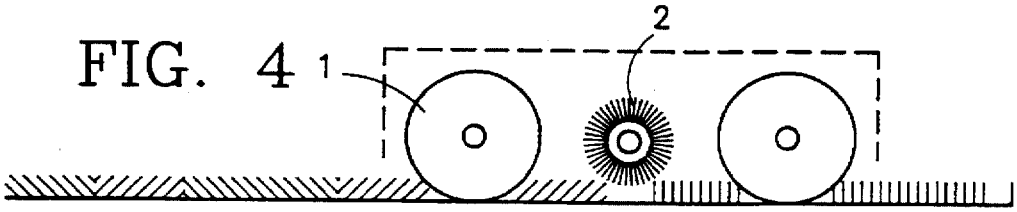
FIG. 4 is a schematic lateral view of the preferred apparatus shown in FIG. 3.

In the embodiment of FIGS. 3 and 4, the brushes 2 are still in one row, but they can rotate independently from each other in either direction. Likewise, the brushes can be braked or stopped, or can rotate freely, independently from each other. When a brush is locked or is rotating backwards, the grass blades bow in the direction of the run of the apparatus. When a brush is rotating forward, at a speed which is greater than the speed of the apparatus, the grass blades bow in an opposite direction. The apparatus can therefore work a whole strip in one pass. When the apparatus reaches the end of a strip, it turns back and immediately starts working the next strip, in the opposite way.

On the way to the surface to be marked, one can let the brushes rotate freely, if the apparatus is not equipped with a device by means of which the brushes can be raised up. In certain cases, it might, however, be useful to equip the apparatus with such a brush raising device.

Figure 5:
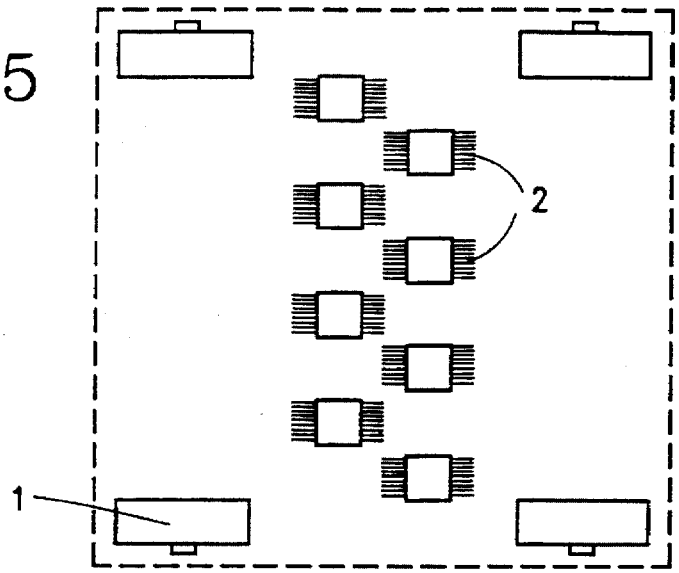
FIG. 5 is a schematic plan view of a variant of the preferred apparatus shown in FIG. 3, in which the brushes are staggeredly placed.
Figure 6:
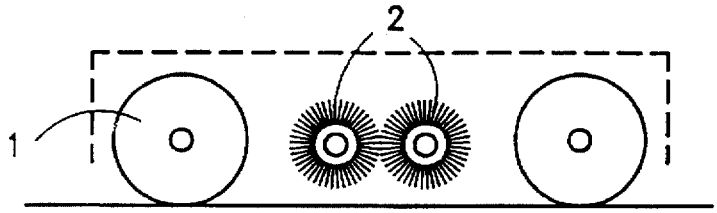
FIG. 6 is a schematic lateral view of the preferred apparatus shown in FIG. 5.

FIGS. 5 and 6 show an embodiment in which the brushes are staggeredly fixed to the apparatus, which makes assembly of the transmissions and control devices easier, and makes it possible to work the whole grass surface, without any gaps. An automatic device, of a conventional type, makes the brushes work at the right time, in spite of their staggered position.

Figure 7:
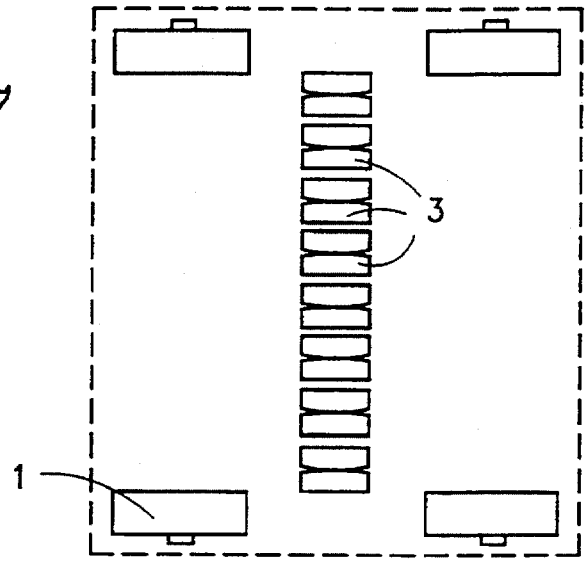
FIG. 7 is a schematic plan view of a variant of the preferred apparatus shown in FIGS. 1 and 2, in which the brushes have been replaced by rollers.
Figure 8:
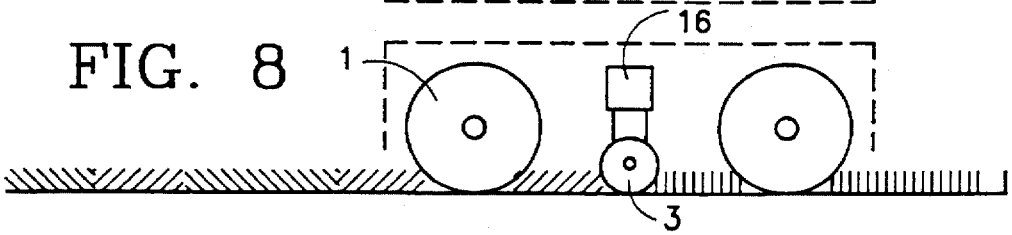
FIG. 8 is a schematic lateral view of the preferred apparatus shown in FIG. 7.
Figure 9:
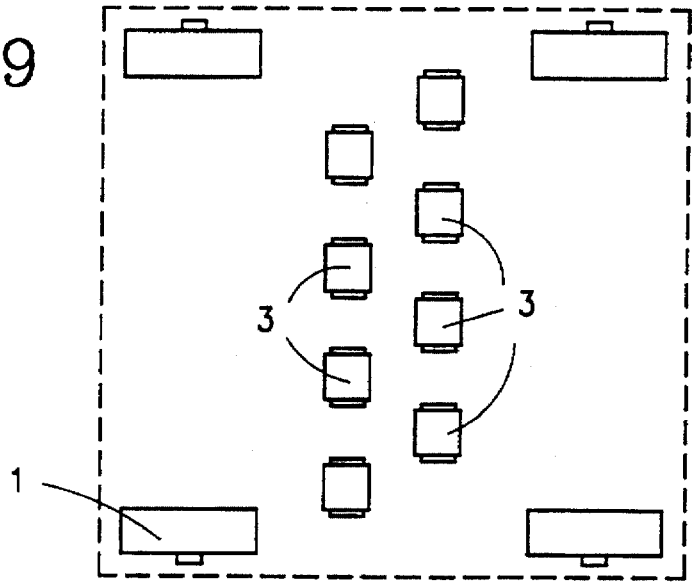
FIG. 9 is a schematic plan view of a variant of the apparatus shown in FIGS. 7 and 8, in which the rollers are staggered.
Figure 10:
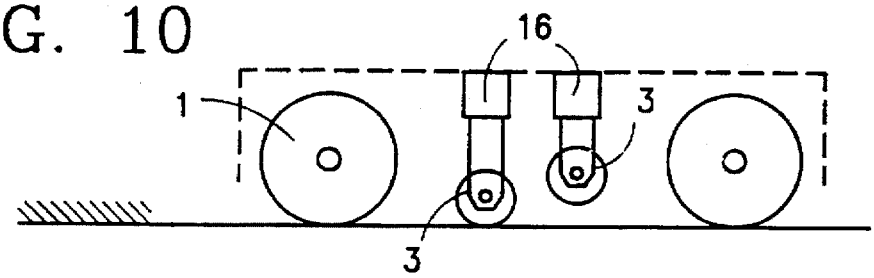
FIG. 10 is a schematic lateral view of the preferred apparatus shown in FIG. 9.

In the embodiment shown in FIGS. 7 and 8, the row of brushes is replaced by a row of rollers 3 which are mounted on their axes so that they can freely rotate. In the embodiment of FIGS. 9 and 10, the rollers are staggered and fixed. An automatic device, of a conventional type, makes it possible to lower respective rollers at the right time in spite of their staggered position. The rollers of FIGS. 7 and 8 have a central division which makes it possible to support the rollers on central bearings or ball bearings, while the rollers of FIGS. 9 and 10 are supported by bearings which are placed on each side of the rollers. In both embodiments, the rollers are mounted on a device 16 which makes it possible to bring them down and raise them up independently from each other. In both embodiments, the functioning of the apparatus is the same as that of the apparatus shown in FIGS. 1 and 2. In other words, it is necessary to make the apparatus pass twice on the same strip if one wishes to work the whole surface.

Figure 11:
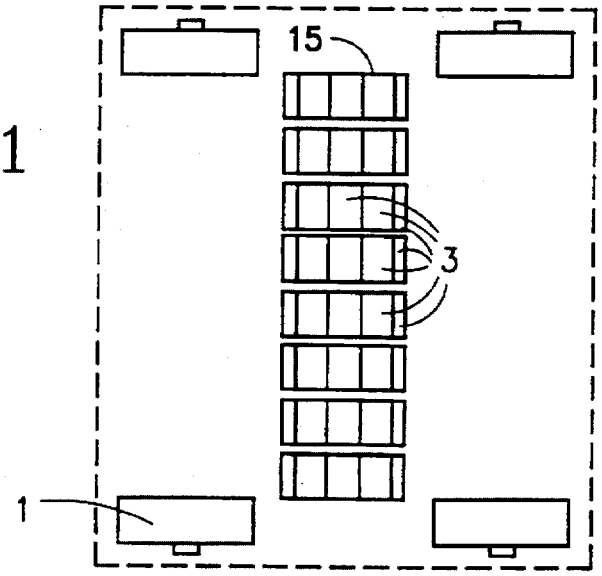
FIG. 11 is a schematic plan view of a further embodiment of the variant shown in FIGS. 7 and 8, in which the rollers are mounted on rotating barrels.
Figure 12:
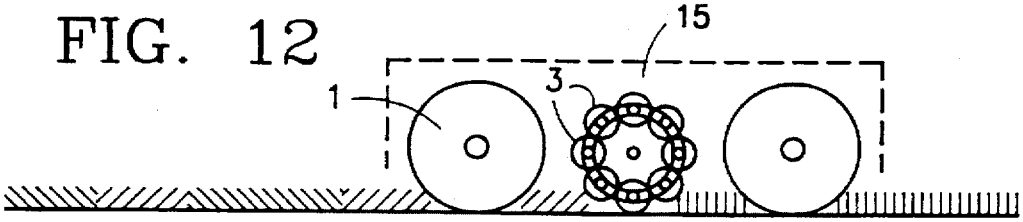
FIG. 12 is a schematic lateral view of the preferred apparatus shown in FIG. 11.

In the embodiment shown in FIGS. 11 and 12, the row of brushes shown in FIGS. 3 and 4 is replaced by a row of rotating barrels 15 on the periphery of which rollers 3 are mounted so that they can freely rotate around axes which are parallel to that of the barrel. The barrels 15 can rotate in two ways, or be braked or stopped, independently from each other, by means of engines which are not shown. When a barrel is stopped or rotates backwards, the grass blades lean in the same direction as the run of the apparatus. When the barrel rotates forward, at a speed which is higher than that of the apparatus, the grass blades lean in an opposite direction. The apparatus can therefore work a whole strip in one way. When it has arrived at the end of a strip, it turns back and immediately begins to work the next strip, in the opposite way. The apparatus is preferably equipped with a device which makes it possible to raise the barrels in order to avoid damage to them during the way to and from the grass surface.

Figure 13:
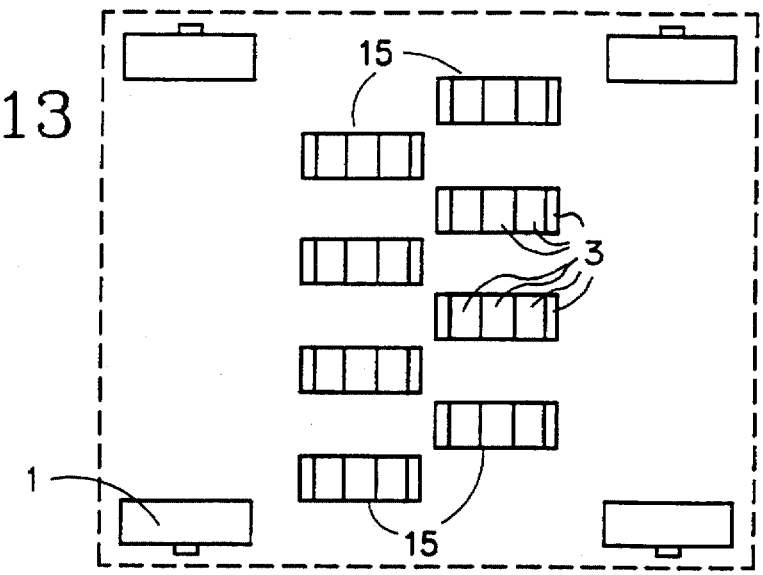
FIG. 13 is a schematic plan view of the apparatus shown in FIGS. 11 and 12 in which the rotating barrels bearing the rollers are staggered.
Figure 14:
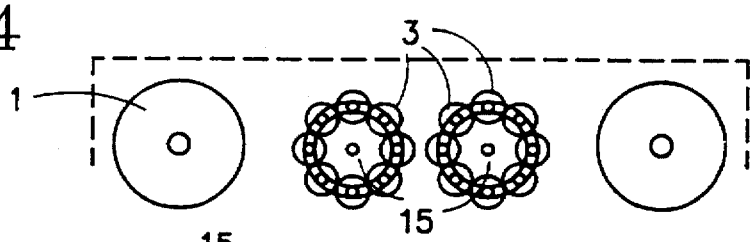
FIG. 14 is a schematic lateral view of the apparatus shown in FIG. 13.

FIGS. 13 and 14 show a version of this latter embodiment, in which the rotating barrels 15 are staggeredly placed with the advantages mentioned above in connection with FIGS. 5 and 6. In this version, the device adapts the functioning of the barrels to the space which is between the barrels.

Figure 15:
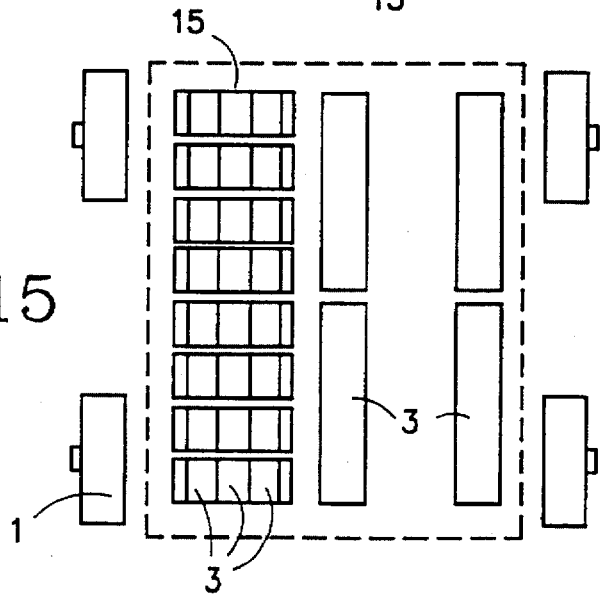
FIG. 15 is a schematic plan view of a further embodiment of the preferred apparatus, in which the rollers which do not support the apparatus are mounted on rotating barrels.
Figure 16:
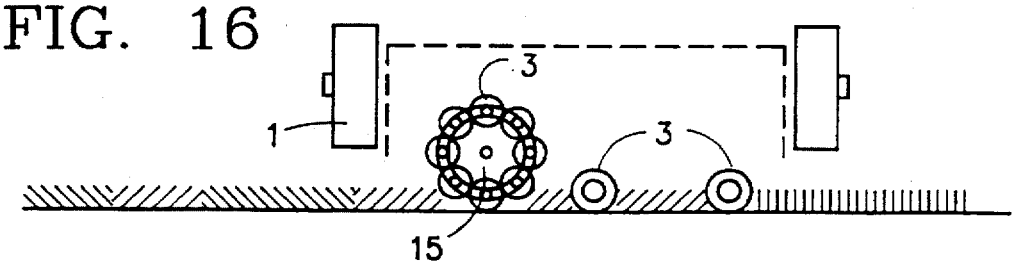
FIG. 16 is a schematic lateral view of the preferred apparatus shown in FIG. 15.

In the embodiment schematically shown in FIGS. 15 and 16, the apparatus has eight barrels 15 which bear rollers 3, and moreover has four rollers 3 arranged in pairs. The axes of the wheels 1 are perpendicular to the axes of the rollers. The apparatus has means for raising the wheels, so that the apparatus can be supported by the two pairs of rollers. The apparatus is brought to the grass surface to be marked by means of the wheels which are down. When the apparatus has arrived, the wheels are raised up and the apparatus moves perpendicularly to its direction of arrival on the grass surface by means of the two pairs of rollers which are driven by one or more engines. The two rollers of each pair are separated by a small space which avoids friction. It is easy to make the apparatus turn by braking the rollers located on the same side of the apparatus, which is possible by means of a differential mounted on the transmission. A differential is not necessary in the case when each roller is driven by a separate engine.

The device which makes it possible to raise and to lower the wheels is not shown here. It is a conventional device, like many others which have been in existence for decades in some models of trucks (semi-trailers) or planes (landing gears).

The length of each pair of rollers and of the rotating barrels 15 corresponds to the width of a strip 14 of the grass surface. All the blades of the grass of the strip are first directed by the supporting rollers in the direction of the run of the apparatus. Then, the rotating barrels pass and give a different or an identical direction to the blades, depending on the direction and speed of their rotation, as explained in connection with FIGS. 11 and 12. A strip can therefore be worked in one way. However, if one wishes to work the next strip on the way back, it is necessary to turn the apparatus around in order to avoid deletion by the supporting rollers of the markings made by the rotating barrels, as the supporting barrels would follow the rotating barrels if the apparatus was not turned around.

Figure 17:
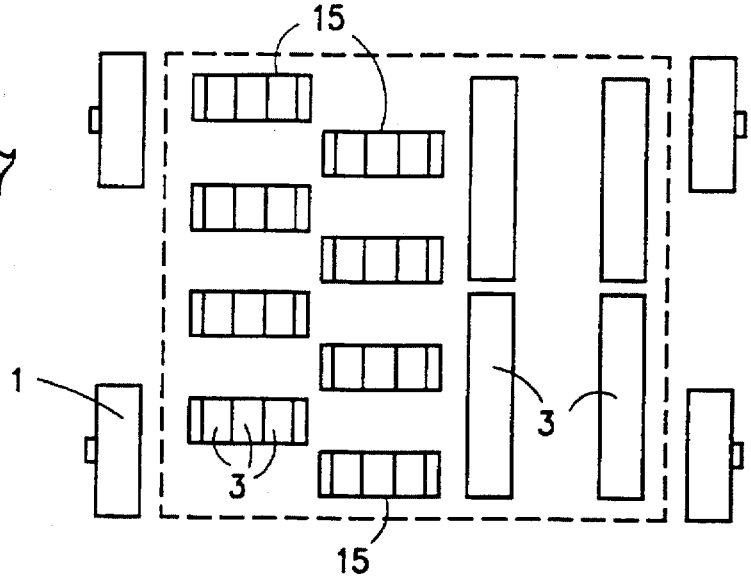
FIG. 17 is a schematic plan view of a variant of the preferred apparatus shown in FIGS. 15 and 16, in which the rotating barrels bearing the rollers have been staggered.
Figure 18:
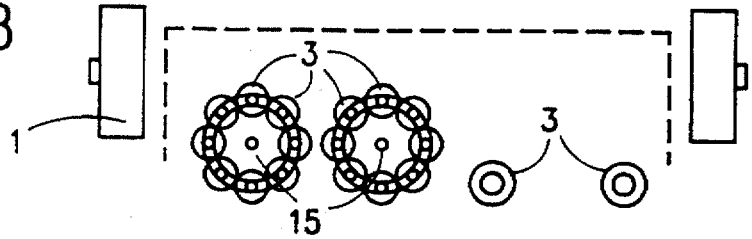
FIG. 18 is a schematic lateral view of the preferred apparatus shown in FIG. 17.

FIGS. 17 and 18 show a variant of this latter embodiment, in which the rotating barrels are staggered to obtain the advantages mentioned in connection with FIGS. 5 and 6, and 13 and 14. In this variant, a device also adapts the functioning operation of the barrels to the space which is between the two rows of barrels.

Figure 19:
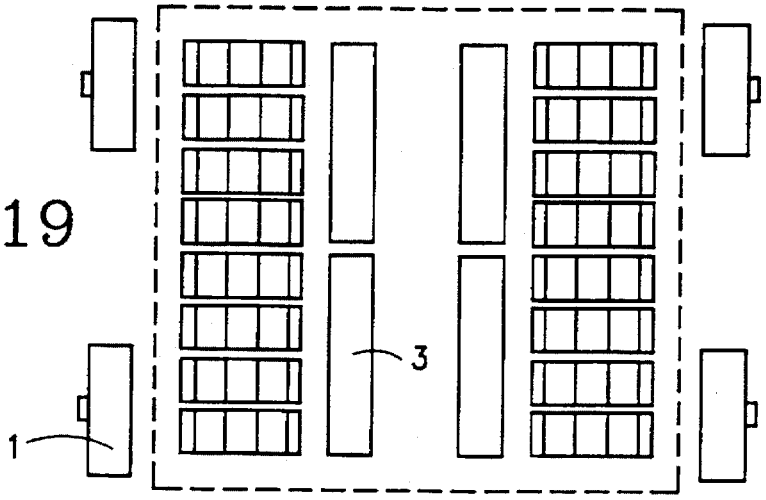
FIG. 19 is a schematic plan view of a variant of the preferred apparatus shown in FIGS. 15 and 16, in which the rotating barrels have been fixed on both sides of the supporting rollers.
Figure 20:
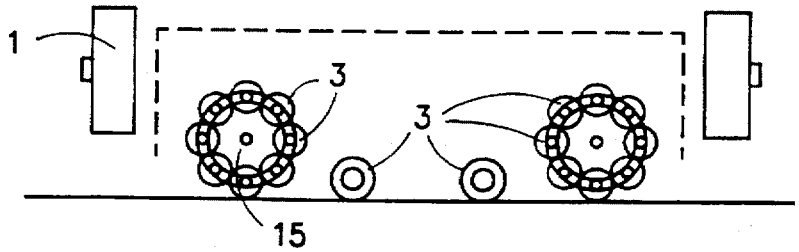
FIG. 20 is a schematic lateral view of the preferred apparatus shown in FIG. 19.
Figure 21:
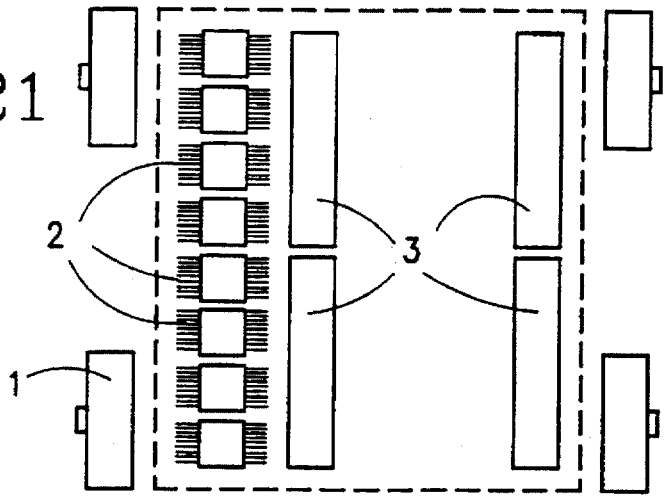
FIG. 21 is a schematic plan view of a variant of the preferred apparatus shown in FIG. 15, in which the non-supporting rollers mounted on rotating barrels have been replaced by rotating brushes.
Figure 22:
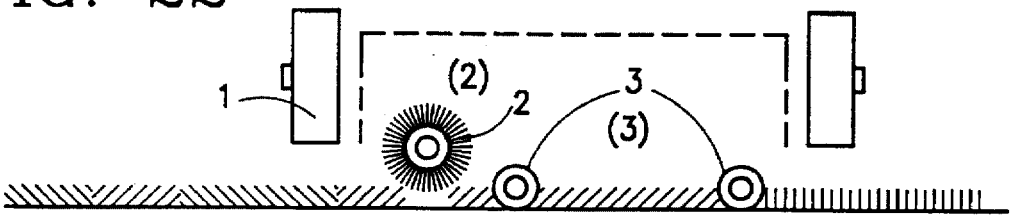
FIG. 22 is a schematic lateral view of the preferred apparatus shown in FIG. 21.
Figure 23:
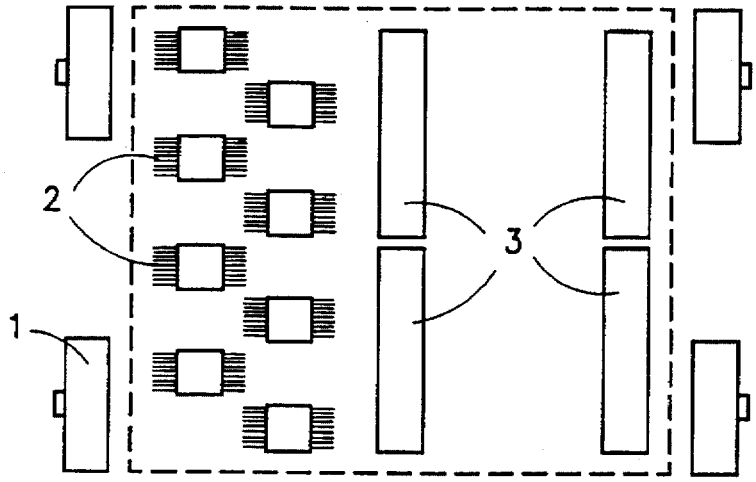
FIG. 23 is a schematic plan view of a variant of the preferred apparatus shown in FIG. 17, in which the rotating barrels which bear rollers have been replaced by rotating brushes.
Figure 24:
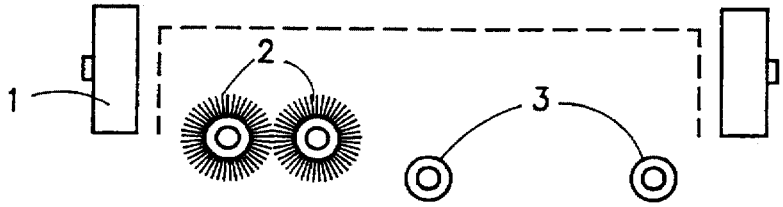
FIG. 24 is a schematic lateral view of the preferred apparatus shown in FIG. 23.
Figure 27:
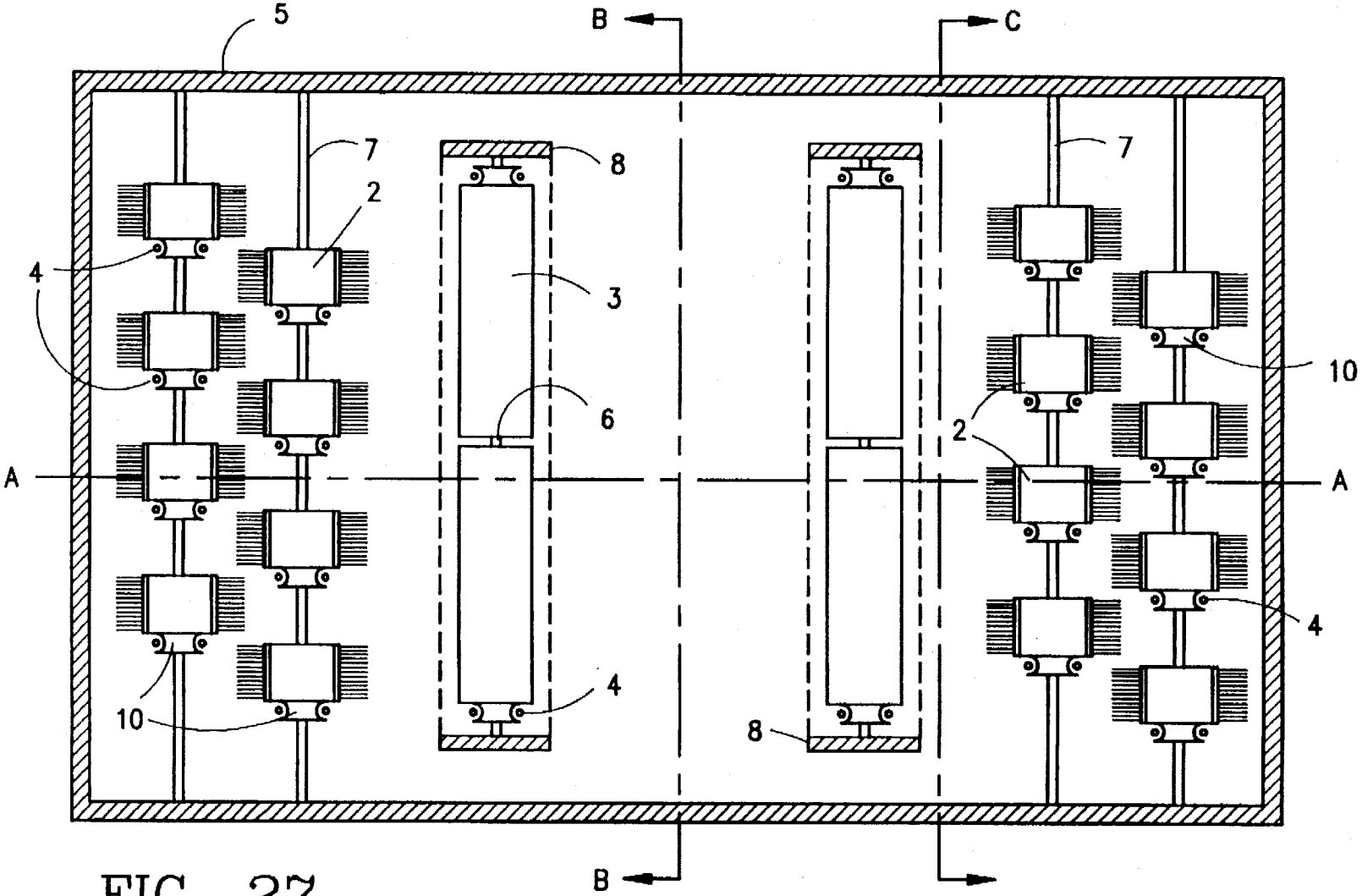
FIG. 27 is a plan view of a variant of the preferred apparatus shown in FIG. 25, in which the rotating brushes have been staggered and the power of the engine is transmitted through belts.
Figure 28:
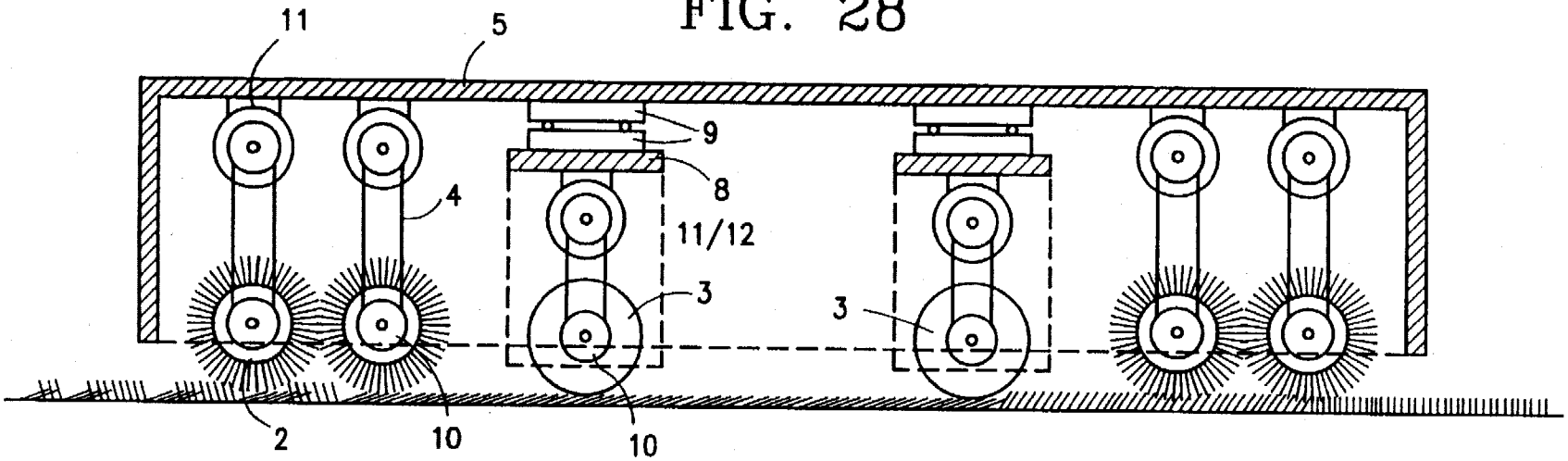
FIG. 28 is a cross section according to A—A of the preferred apparatus shown in FIG. 27.
Figure 29:
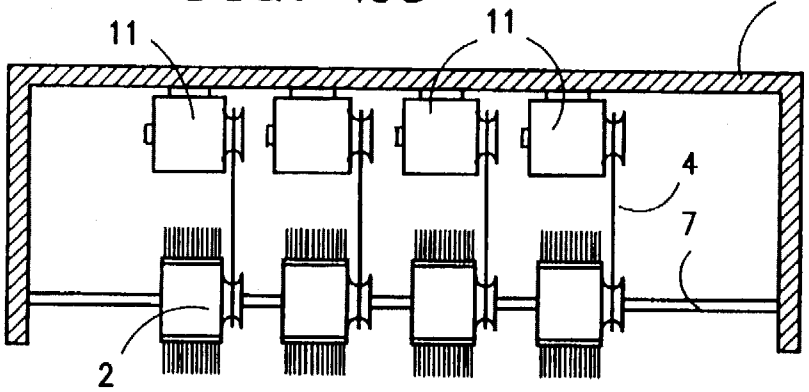
FIG. 29 is a cross section according to B—B of the preferred apparatus shown in FIG. 27.
Figure 30:
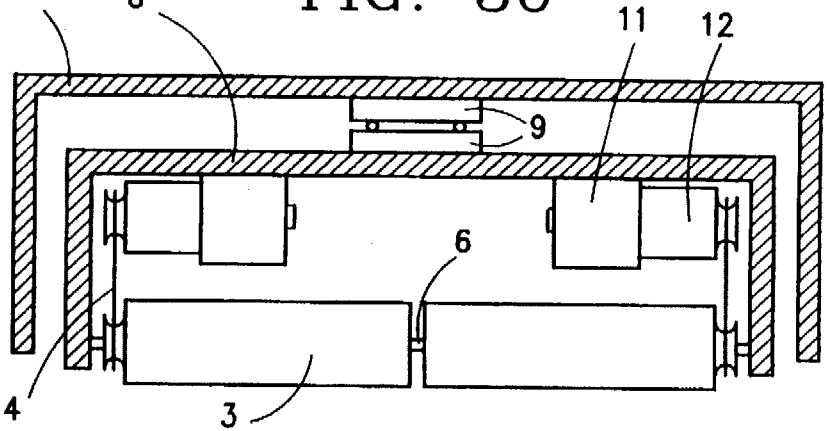
FIG. 30 is a cross section according to C—C of the preferred apparatus shown in FIG. 27.

FIGS. 19 and 20 show a variant of the embodiment of FIGS. 15 and 16, in which the two pairs of supporting rollers are bordered on two sides by two rows of rotating barrels which bear rollers. The presence of a row of barrels on each side of the supporting rollers makes it possible to mark the next strip on the way back, without turning back the apparatus. In principle, however, it is preferable to work each strip in the same way to obtain as uniform a direction as possible for the grass blades.

In a variant which is not shown here, the apparatus in the embodiment of FIGS. 19 and 20 has rotating barrels staggeredly mounted, with the above described advantages.

FIGS. 21 to 26 show variants of the embodiments shown in FIGS. 15 to 20, in which the barrels have been replaced by rotating brushes. Like the barrels in the preceding embodiments, each rotating brush can rotate in either direction independently of the other brushes.

FIGS. 27 to 30 show the features of the apparatus schematically shown in FIGS. 25 and 26, with the difference that the brushes are staggered, with all of the advantages noted above deriving from such arrangement.

Each rotating brush 2 can freely rotate around the axis 7 and is driven by a belt 4 which drives the brush by means of a pulley 10 which is attached to the brush. Each belt 4 is driven by an engine 11, which is preferably electrical, and which is independent of the other engines. The brushes are placed at such a height that they penetrate the layer of grass, but do not touch the soil. The axes 7 which support the brushes are fixed by their ends to the main chassis 5. Each pair of supporting rollers is supported by an axis 6. The supporting rollers freely rotate around the axis. At each end of each axis are pulleys 10 each pulley being fixed to a supporting roller 3. Belts 4 transmit the rotation of the engines to the rollers. Each belt is driven by an independent engine 11. Each engine drives the belt through a train of gears 12. The axes which support the rollers, as well as the engines and the trains of gears, are fixed to a secondary chassis 8. This secondary chassis 8 is fixed to a main chassis 5 through the medium of a ball bearing 9 which makes it possible for the secondary chassis to turn in a small angle to steer the apparatus. As each roller is driven by an independent engine, a differential is superfluous.

The engines are electrical and are powered by an accumulator. Of course, other types of engines could be used, but they would be less convenient. Likewise, it would be possible to use transmission means other than belts and pulleys, for example chains or gears.

The engines and the transmissions which drive the rollers give the apparatus, thanks to a high gear reduction, a speed which is approximately constant, and which is equivalent to that of a walking man even if the weight changes.

The engines for the rollers are started manually, by switches commanded by the driver. For the first strip, the driver can manually command the steering device, which makes it possible to make the two secondary chassis pivot with regard to the main chassis. For the next strips, the computer automatically steers the apparatus.

Figure 31:
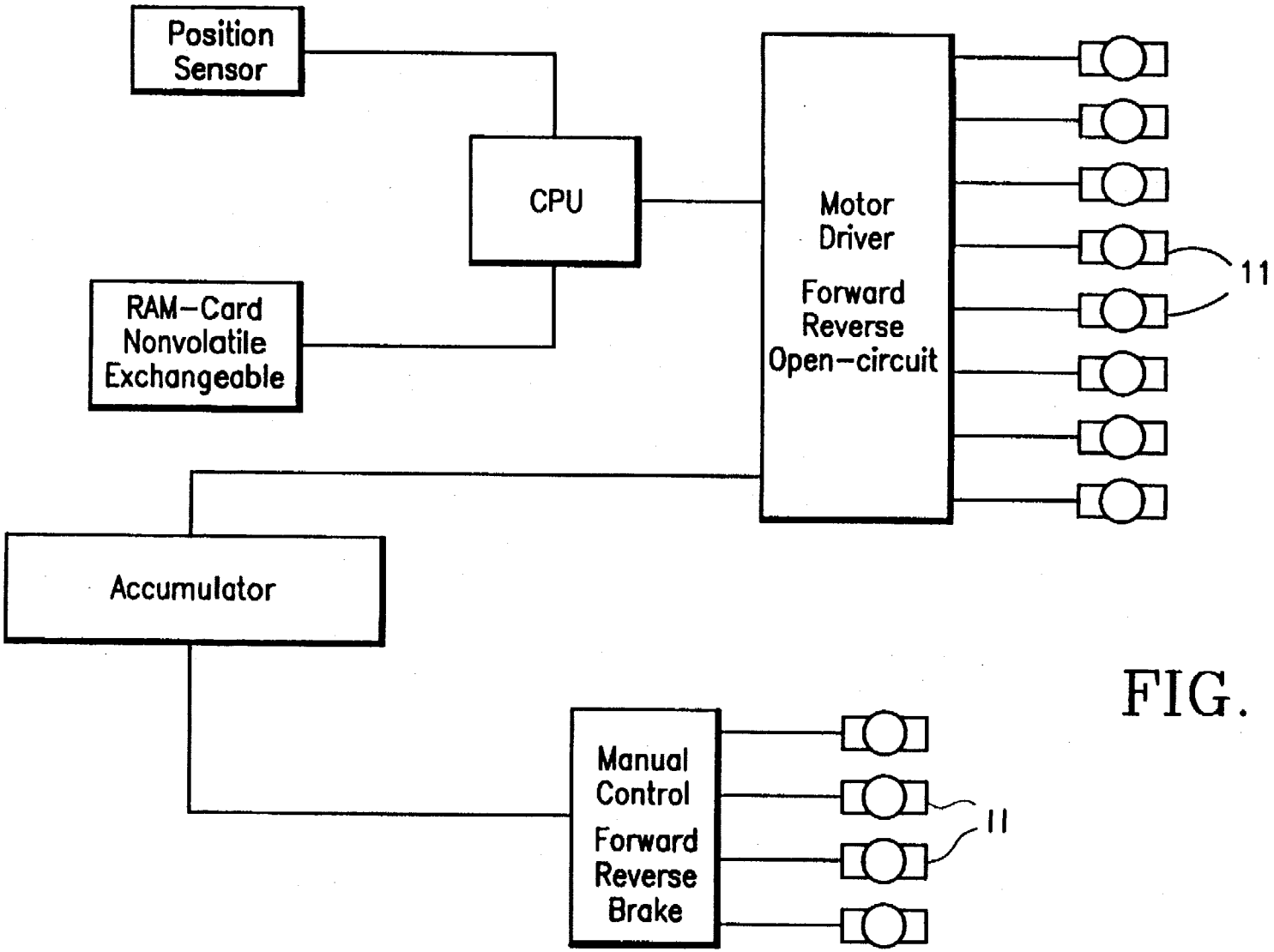
FIG. 31 is a diagram of an electronic and electric command device for the preferred apparatus.

Each of the engines which drive the brushes is controlled and actuated by a computer according to the position of the brushes on the grass surface. The data which are transmitted to the computer are registered on a RAM card. FIG. 31 gives a diagram of the relations between the various electric or electronic devices which drive the apparatus. The torque necessary to make a brush rotate, whether in a direction corresponding to the direction of the apparatus or in the contrary direction, is more or less constant, depending on the elasticity of the bristles of the brush.

In comparison with the above described versions in which the wheels cannot be raised up, the advantage of this preferred embodiment lies in a better distribution of the weight, preventing the wheels from marking furrows in the ground. In comparison with the versions in which the brushes are replaced by barrels with rollers, this embodiment avoids the large weight and dimensions of the barrels.

Of course, in each contemplated embodiment, the number of devices may vary according to the needs of the user, including the number of rollers, barrels, brushes, engines, pulleys or wheels.

In the preferred embodiments, the method for marking grass fields is automatically carried out by a computer. The image or images, or the sign or signs, for example a name or a word constituting a trademark, which must be printed on the grass, are entered in the computer. The image or images and/or the sign or signs are marked at points which correspond to a division of the grass surface into several sectors 13.

The driver first places the apparatus on the starting line 15, and then drives it manually along the first strip. The apparatus is equipped with a device which deposits small balls made of ferromagnetic metal on an edge of the strip, i.e. on the left of the apparatus in the embodiment shown in FIG. 33, at regular intervals, for example at the limit of each sector 13. The apparatus is moreover equipped with magnetic sensors which are connected to the computer, and with a magnetic device by means of which the balls are recuperated on the way. The balls are deposited in the path of the apparatus on the first strip. The computer commands the dropping of the balls and actuates the brushes and/or rollers at the moment when the apparatus is in a definite position.

In order to determine this position, on the first pass, the preferred method is to use an odometer which is connected and driven by one or more rollers which support the apparatus, or by a wheel attached to the apparatus and which freely rolls on the grass. The odometer may be a common odometer of the type used, for example, in automobiles. The odometer transmits its data to the computer, which transmits its instructions to the engines according to the program entered by the driver. During passage on the second strip, the sensors transmit to the computer the data they collect concerning the position of the apparatus with regard to that of the balls, so that the odometer is no longer required. The position of the balls not only defines the direction given to the apparatus, but also the moment when the brush or roller must be actuated to give the grass blades the required direction in a definite sector, as well as the positions at which the balls are to be deposited in a new line along the second strip.

As the apparatus recovers the balls deposited on the edge of the first strip, it deposits balls on the edge of the second strip. Of course, these balls can be the same balls which are transferred by the apparatus from the border of the first strip to the border of the second strip. After having worked the second strip, the driver again places the apparatus on the starting line, at the beginning of the next strip and the process starts again. When the apparatus has arrived at the last strip, the computer stops the ball depositing device, while the ball collecting device still collects the balls deposited on the border of the preceding strip.

In another embodiment of the preferred method, the computer commands the marking of a line in the grass, on the edge of the strip. On the next strip, the driver drives the apparatus along the marked line. The line is preferably marked in such a way that the passing of the apparatus for the working of the next strip deletes it. In other words, it is necessary that the apparatus passes along the marked line. At the same time as the apparatus deletes this first line, it makes a second one, at the edge of the second strip. This second line is deleted by the passing of the apparatus on the third strip. The process starts again until the whole surface has been worked.

Figure 33:
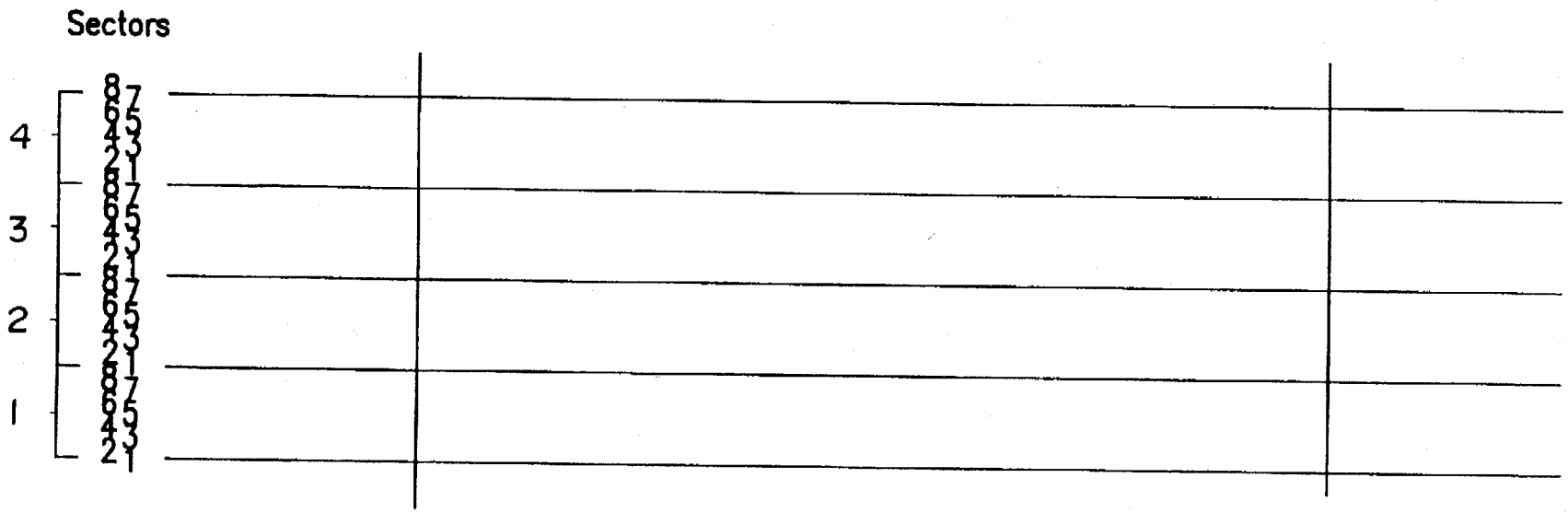
FIG. 33 shows a network of metallic cables or wires which is buried under the grass surface and which allows positioning the apparatus on the grass surface.

A further embodiment of the preferred method involves burying in the ground, some centimeters under the surface, a metallic network which corresponds to the edges of the strips and to the starting and arrival lines, as shown in FIG. 33. The apparatus is equipped with sensors which transmit the position of the apparatus to the computer. A measuring device informs the computer and the driver of any difference between the real position and the desired position entered in the computer. Here too, the steering can be automatic or manual.

Figure 34:
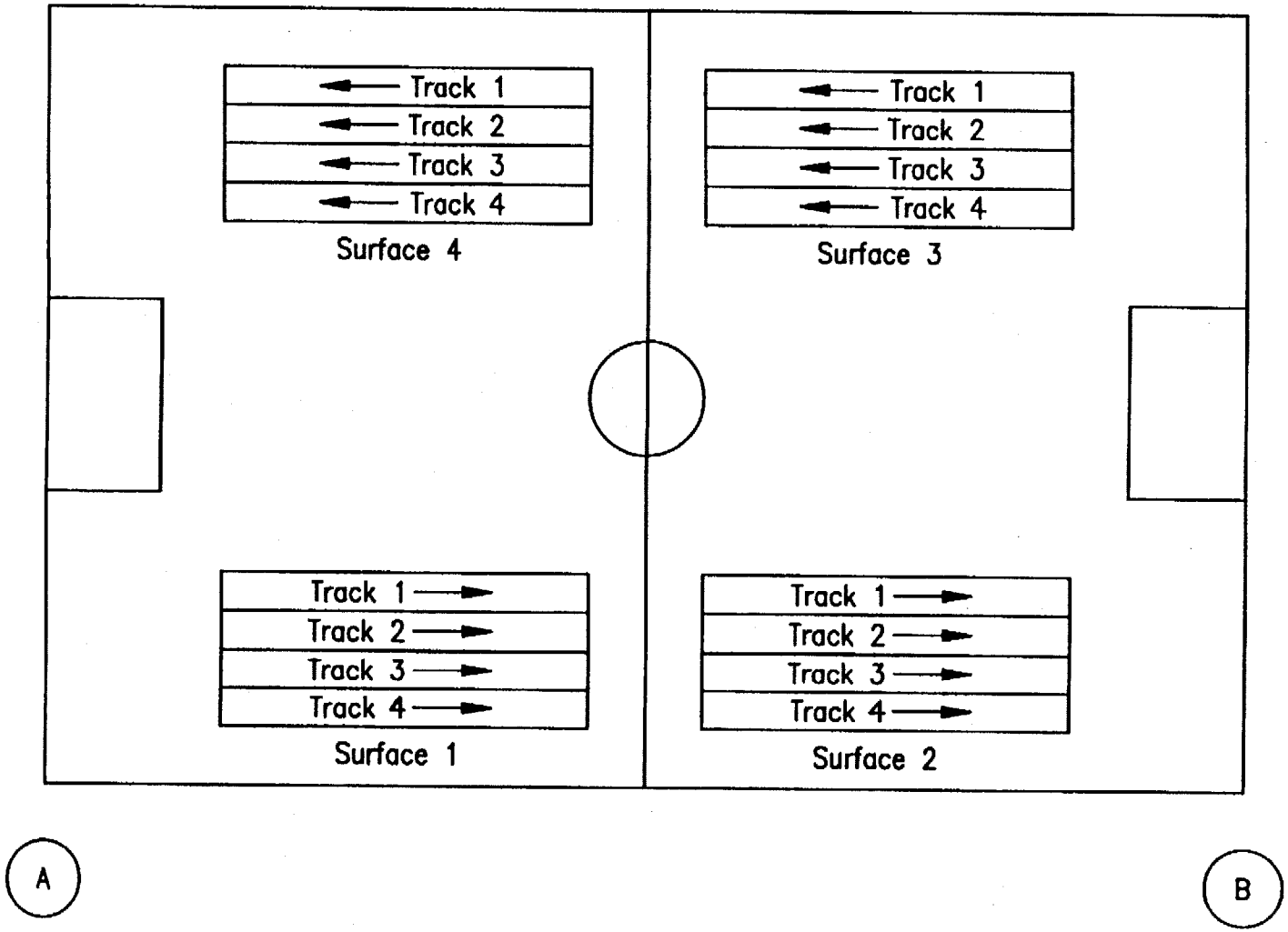
FIG. 34 shows a sports field with four surfaces to mark and two tranceivers which allow positioning the apparatus on the grass surface.

In a further embodiment of the preferred method, transceivers are placed on the ground and on the apparatus. Such devices can measure the distance and/or the angle which makes it possible for the computer to calculate the position of the apparatus with regard to the transceivers placed on the ground. FIG. 34 schematically shows that such transceivers could be placed at points A and B. Either microwave, ultrasonic, or infrared transceivers could be used in such a system. Here too, the steering can be automatic or manual.

Lastly, it is possible to use a system in which transceivers are on satellites, as is the case with the GPS system. Other embodiments, modifications, and variations thereof will also occur to those skilled in the art, and thus it is intended that the invention not be limited by the above description, but rather that it be defined solely by the appended claims.

We claim:

1. A method for marking grass fields, comprising the steps of directing a part of the blades of the grass surface in one direction, and directing or leaving at least another part of the blades to be directed in at least one other direction so that at least one of the parts forms a marking on the grass, wherein the step of directing the blades of at least the part of the grass surface comprises the step of directing blades by blade directing means, further comprising the steps of dividing a model of the image into several points, dividing the grass surface into several sectors, and operating the blade directing means on the grass in connection with the position of said blade directing means on sectors which correspond to points of the model of the image.

2. A method as claimed in claim 1, further comprising the step of registering the position of said apparatus on the grass surface through sensors which detect magnetizable bodies that are deposited or buried at definite places on or under said grass surface.

3. A method as claimed in claim 1, further comprising the step of registering the position of said apparatus on the grass surface by means of a device which is able to at least receive electromagnetic or sonic waves.

4. A method as claimed in claim 3, wherein said electromagnetic waves are signals from geostationary satellites.

5. A method as claimed in claim 1, wherein the step of directing the blades comprises the step of directing the blades of at least a part of the grass surface by means of at least one brush and by means of at least one roller.

6. A method as claimed in claim 1, wherein the step of operating of the blade directing means comprises the step of inputting to a computer (1) said model, (2) an instantaneous position of the roller on the grass surface, and (3) instructions which operate the brush in each sector based on the corresponding point of the model and the position of the roller.

7. A method as claimed in claim 6, further comprising the step of registering the position of said apparatus on the grass surface through sensors which detect magnetizable bodies that are deposited or buried at definite places on or under said grass surface.

8. A method as claimed in claim 6, further comprising the step of registering the position of said apparatus on the grass surface by means of a device which is able to at least receive electromagnetic or sonic waves.

9. A method as claimed in claim 8, wherein said electromagnetic waves are signals from geostationary satellites.

10. A method as claimed in claim 1, wherein the step of directing the blades comprises the step of directing the blades of at least a part of the grass surface by means of at least one roller.

* * * * *